US008249211B2

(12) United States Patent
Buckley

(10) Patent No.: US 8,249,211 B2
(45) Date of Patent: Aug. 21, 2012

(54) FORCED CONVECTION TARGET ASSEMBLY

(75) Inventor: Kenneth Robert Buckley, Vancouver (CA)

(73) Assignee: Advanced Applied Physics Solutions, Inc., Vancouver, B.C. (CA)

( * ) Notice: Subject to any disclaimer, the term of this patent is extended or adjusted under 35 U.S.C. 154(b) by 0 days.

(21) Appl. No.: 11/168,397

(22) Filed: Jun. 29, 2005

(65) Prior Publication Data

US 2006/0050832 A1 Mar. 9, 2006

Related U.S. Application Data

(60) Provisional application No. 60/583,433, filed on Jun. 29, 2004.

(51) Int. Cl.

| | |
|---|---|
| ***G21G 1/10*** | (2006.01) |
| ***G21G 1/00*** | (2006.01) |
| ***G21C 19/42*** | (2006.01) |
| ***H01J 49/00*** | (2006.01) |
| ***F28F 7/00*** | (2006.01) |
| ***F25B 39/02*** | (2006.01) |
| ***F25B 41/06*** | (2006.01) |
| ***F25D 23/12*** | (2006.01) |

(52) U.S. Cl. ..... 376/190; 376/192; 376/193; 376/194; 376/195; 376/156; 376/310; 250/284; 165/80.4; 165/903; 165/911

(58) Field of Classification Search ..... 376/192, 376/195, 194, 156, 310, 190, 193; 165/903, 165/911, 80.4; 62/525, 528, 259; 250/284
See application file for complete search history.

(56) References Cited

U.S. PATENT DOCUMENTS

| | | | | |
|---|---|---|---|---|
| 5,248,613 | A * | 9/1993 | Roubicek | 435/295.1 |
| 5,768,329 | A * | 6/1998 | Berwald | 376/192 |
| 5,917,874 | A * | 6/1999 | Schlyer et al. | 376/194 |
| 6,567,492 | B2 * | 5/2003 | Kiselev et al. | 376/195 |

(Continued)

FOREIGN PATENT DOCUMENTS

CA 2486604 A1 12/2003

(Continued)

OTHER PUBLICATIONS

V.Belov et.al., Liquid metal target for NLC positron source, Proc. of the 2001 P-article Aceelerator Conference, Chicago, Jun. 2001.*

(Continued)

*Primary Examiner* — Erin M Leach
(74) *Attorney, Agent, or Firm* — Harness, Dickey & Pierce, P.L.C.

(57) ABSTRACT

Provided is a modified target assembly in which the target fluid is moved within the target assembly in a manner that increases the effective density of the target fluid within the beam path, thereby increasing beam yield utilizing forced convection. The target may also include optional structures, such as nozzles, diverters and deflectors for guiding and/or accelerating the flow of the target fluid. The target assembly directs the target fluid along an inner sleeve in a direction opposite the direction of the beam current to produce a counter current flow and may also direct the flow of the target fluid away from the inner surface of the inner sleeve and toward a central region in the target cavity. This countercurrent flow suppresses natural convection that tends to reduce the density of the target fluid in the beam path and tends to increase the heat transfer from the target.

19 Claims, 6 Drawing Sheets

U.S. PATENT DOCUMENTS

| | | | | |
|---|---|---|---|---|
| 6,895,064 | B2 * | 5/2005 | Ritter | 376/194 |
| 6,907,097 | B2 * | 6/2005 | Leung | 376/108 |
| 7,127,023 | B2 * | 10/2006 | Wieland | 376/195 |
| 7,200,198 | B2 * | 4/2007 | Wieland et al. | 376/195 |
| 2003/0152187 | A1 | 8/2003 | Ritter | |
| 2004/0228433 | A1 * | 11/2004 | Magill et al. | 376/347 |

FOREIGN PATENT DOCUMENTS

| | | | |
|---|---|---|---|
| JP | 62-101415 | | 5/1987 |
| JP | 1224798 | | 8/1999 |
| JP | 2000-82598 | | 3/2000 |
| JP | 2003139900 | A * | 5/2003 |
| WO | WO 02/101757 | | 12/2002 |
| WO | WO 2004/053892 | A2 | 6/2004 |

OTHER PUBLICATIONS

J Haines, SNS Mercury Target Issues and Development Program, SNS Experimental Facilities, Oak Ridge, Oct. 30, 2000.Fig. p. 6, 7,10.*

Mark, Wender, Design of the Spallation Neutron Source Target.*

R. M. Manglik, Heat Transfer Enhancement Heat Transfer Handbook , by: Bejan, Adrian; Kraus, Allan D. © 2003 John Wiley & Sons, Capture 14.*

Belov et al., (V. Belov, et al.,"Liquid metal target for NLC positron source", in Proceedings of the 2001 Particle Accelerator Conference, Report TPAH126, Chicago, Jun. 2001, http://accelconf.web.cern.ch/Acce/Conf/p01/ PAPERS/TPAH126.PDF-400.4KB ).*

Sven-Johan Heselius et al., "Optical Studies of the Influence of an Intense Ion Beam on High Pressure Gas Targets", Int. J. Appl. Isot. Vo. 33, 1982, pp. 653-659.

L.P. Robertson et al., "Beam Heating Effects in Gas Targets", Aug. 28, 1961, p. 1405.

S.J. Bame et al., "T(*d,n*) $He^4$ Reaction", Sep. 15, 1957, pp. 1616-1620.

B. W. Wieland et al., "Charged Particle Penetration in Gas Targets Designed for Accelerator Production of Radionuclides Used in Nuclear Medicine", Int. J. Appl. Radiat. Isot. vol. 35, No. 5, 1984, pp. 387-396.

O. Solin et al., "Density Reduction and Temperature Mapping in a Ne-Gas Target", Journal of Labelled Compounds and Radiopharmaceuticals vol. XXI, 1984, pp. 1278-1280.

B. W. Wieland et al., "Deuteron Beam Penetration in a neon gas target for producing fluorine-18", Journal of Labelled Compounds and Radiopharmaceuticals vol. XVIII, Nos. 1-2, 1981, pp. 27-29.

T. Köble et al., "The Influence of Convection on High-Pressure Gas Target Densities", Nuclear Instruments and Methods in Physics Research A275, 1989, pp. 460-461.

R. L. Anderson, "SLAC High Power Hydrogen Target", Nuclear Instruments and Methods 70 (1969), pp. 87-89.

F. Tárkányi et al., "Static and dynamic effects in gas targets used for medical isotope production", Nuclear Instruments and Methods in Physics Research A 397 (1997), pp. 119-124.

ISR dated Oct. 17, 2005.

European Search Report dated Apr. 27, 2010 issued in corresponding European Application No. 05761942-1-2208.

Japanese Office Action dated Feb. 1, 2011 issued in corresponding Japanese Application No. 2007-518428 and English translation thereof.

* cited by examiner

FORCED CONVECTION TARGET ASSEMBLY

PRIORITY STATEMENT

This application claims priority from U.S. Provisional Patent Application No. 60/583,433, filed Jun. 29, 2004, the contents of which are hereby incorporated herein by reference in their entirety.

BACKGROUND OF THE INVENTION

The production of radioisotopes typically involves irradiating a target fluid (gas or liquid) maintained within a target assembly with an energetic charged particle beam. The energetic charged particle beam may be characterized by one or more parameters such as particles per second, beam current (typically measured in microamps (μA) or milliamps (mA)), particle velocity, beam energy (typically measured in kilo electron volts (KeV) or mega electron volts (MeV)), and beam power (typically measured in watts (W)). The interaction of one of the energetic particles from the particle beam with a target nucleus in the target fluid will, under the appropriate conditions, tend to produce a nuclear reaction that transforms the target nucleus into a different element.

These nuclear reactions may be written as a shorthand expression X(a,b)Y in which X represents the target nuclei, a is the incoming or beam particle, b is the particle emitted by the nuclei, and Y represents the resultant or product nuclei. An example of such an expression is $^{18}O(p,n)^{18}F$, which indicates a nuclear reaction in which the oxygen isotope $^{18}O$ is struck by a proton, which enters the nucleus and causes a neutron to be ejected, resulting in a change in the nuclear structure to the fluorine isotope $^{18}F$. Another example of such an expression is $^{14}N(p,\alpha)^{11}C$, which indicates that the nitrogen isotope $^{14}N$ is struck by a proton, which enters the nucleus and causes an α particle to be emitted, resulting in a change in the nuclear structure to the carbon isotope $^{11}C$.

The probability of a nuclear reaction occurring is referred to as the cross-section and is a function of the incoming particle energy and differs for each combination of target nuclei, incoming particle, and leaving particle. For the production of a particular radioisotope, type of particle, the beam current, beam energy, target nuclei and target density may be selected to increase the likelihood of the preferred nuclear reaction and the yield of the desired product.

The systems used for generating the energetic charged particle beams, such as cyclotrons, electrostatic accelerators and radiofrequency quadrupoles, are typically expensive (usually more than US$1,000,000) to purchase, expensive to maintain and to operate and require highly skilled technical staff. In some cases, the preferred target material may also be expensive to purchase, such as enriched $^{18}O$ gas (typically more than US$500 per liter) and enriched $^{18}O$ water (typically more than US$100 per milliliter). These enriched $^{18}O$ materials are, however, commonly used target materials for the production of the fluorine isotope $^{18}F$. The $^{18}F$ is, in turn, frequently utilized in the production of radiolabeled materials, such as the radiopharmaceutical $^{18}F$-fluorodeoxyglucose (FDG), that may be used in positron emission tomography (PET) for the diagnosis of cancer and other conditions.

As noted above, the cross-section parameter reflects the probability that the desired nuclear reaction will occur. The yield of the desired product can, therefore, be enlarged by increasing the number of incoming energetic particles, i.e., the beam current. Increasing the number of incoming energetic particles, while maintaining the same beam energy, will tend to increase the number of product nuclei generated. The range, or distance travelled through a medium, of a charged particle is a function of the energy of the charged particle and the properties of the medium or media through which it will travel. The range values for a wide range of particles, energies and media are generally known or readily available to those of skill in the art.

There is a phenomenon in fluid targets, particularly gas targets, which tends to reduce the energy deposited in the target material even as the total power applied to the target assembly increases if the beam energy remains substantially constant. This phenomenon is referred to as a density reduction. This phenomenon has been attributed to the interaction between the charged particle beam and the target fluid during which most of the energy transfer results in ionization rather than nuclear reactions. This energy transfer heats the target fluid, causing it to rise and consequently move away from the region of the incoming particle beam.

This phenomenon was first noted in Bame S. J. Jr., Perry J. E. Jr., *T(d,n)4He Reaction*, Physical Review, Vol. 107, pp. 1616-20, 1957. Robertson et al.'s 1961 article, i.e., Robertson L. P., White B. L., Erdman K. L., *Beam Heating Effects in Gas Targets*, Review of Scientific Instruments, Vol. 32, p. 1405, 1961, provides a study of beam heating. And, in 1982, Heselius et al. published photographs of the beam interaction in a gas target in Heselius S. J., Lindbolm P., and Solin O., *Optical Studies Of The Influence Of An Intense Ion Beam On High-Pressure Gas Targets*, Int'l J. of Applied Radiation, Vol. 33, pp. 653-659, 1982, that depicted the extended beam travel as the beam current increased for a fixed energy. Each of the referenced articles is hereby incorporated by reference, in their entirety.

This movement of the target nuclei away from the beam region reduces the number of nuclei in the beam path (density) and hence increases the range of the beam, or in the case of a fixed distance, decreases the proportion of the beam power transferred to the target nuclei. This in turn decreases the number of the nuclear reactions that will occur and reduces the number of product nuclei that are produced.

A factor affecting the density reduction in a gas target is the ability of the target assembly to maintain the gas at a uniform temperature. One approach aims to suppress the convective movement of the heated target gas away from the incident particle beam by configuring the target assembly to provide a target envelope that is closely matched to the configuration of the incoming charged particle beam, thereby forcing substantially all of the target nuclei to remain in the path of the beam. Other approaches include increasing the length of the target and/or increasing the loading pressure to increase the number of target nuclei that will be exposed to the incident particle beam substantially above those values required when little heat is generated in the target assembly. These approaches can compensate to some degree for the pressure differential that will be generated within the target fluid inside the target envelope and the resulting localized density reduction.

An additional factor affecting the process yield is that the incoming charged particle beam tends to lack spatial uniformity with respect to particle distribution. Indeed, a typical distribution of particles within the beam will exhibit a substantially gaussian radial distribution perpendicular to the beam direction. This means that the particle distribution within the beam is biased toward a central portion of the beam and the convective movement of the target gas will tend shift the target nuclei to areas within the target assembly that are exposed to fewer beam particles, thereby tending to decrease production of the desired product isotope(s).

As a result, even closely matching the configuration of the target chamber to the beam shape will generally not fully counteract the heating induced density reduction of the target gas in the higher beam density regions. Further, target assemblies in which the target chamber includes little or no volume that is not within the beam strike region tend to experience much greater pressure increases than targets that include substantial target chamber volume that is not within the beam strike region. In order to accommodate the greater pressure increases experienced within the reduced volume target chamber, the chamber beam windows and chamber walls must be made stronger which, in the case of the chamber beam window, can reduce the percentage of beam energy and/or beam current that can be applied to the target gas.

BRIEF SUMMARY OF THE INVENTION

The invention provides a modified target assembly in which the target fluid is moved within the target assembly in a manner that increases the effective density of the target fluid within the beam path, thereby increasing beam yield. As detailed below, the invention utilizes forced convection, and optional structures arranged within the target envelope, to direct the target fluid within an inner sleeve in a direction opposite the direction of the beam current, i.e., produce a counter current flow of the target fluid, and optionally direct the flow of the target fluid toward a central region. This countercurrent flow of the target fluid suppresses, to some degree, the natural convective effects that tend to reduce the effective density of the target fluid within the beam path as a result of fluid heating and tend to increase the heat transfer from the target, allowing operation at lower temperatures and/or pressures.

BRIEF DESCRIPTION OF THE DRAWINGS

The above and other features and advantages of the present invention will become more apparent by describing in detail exemplary embodiments thereof with reference to the attached drawings in which.

Figure 1:
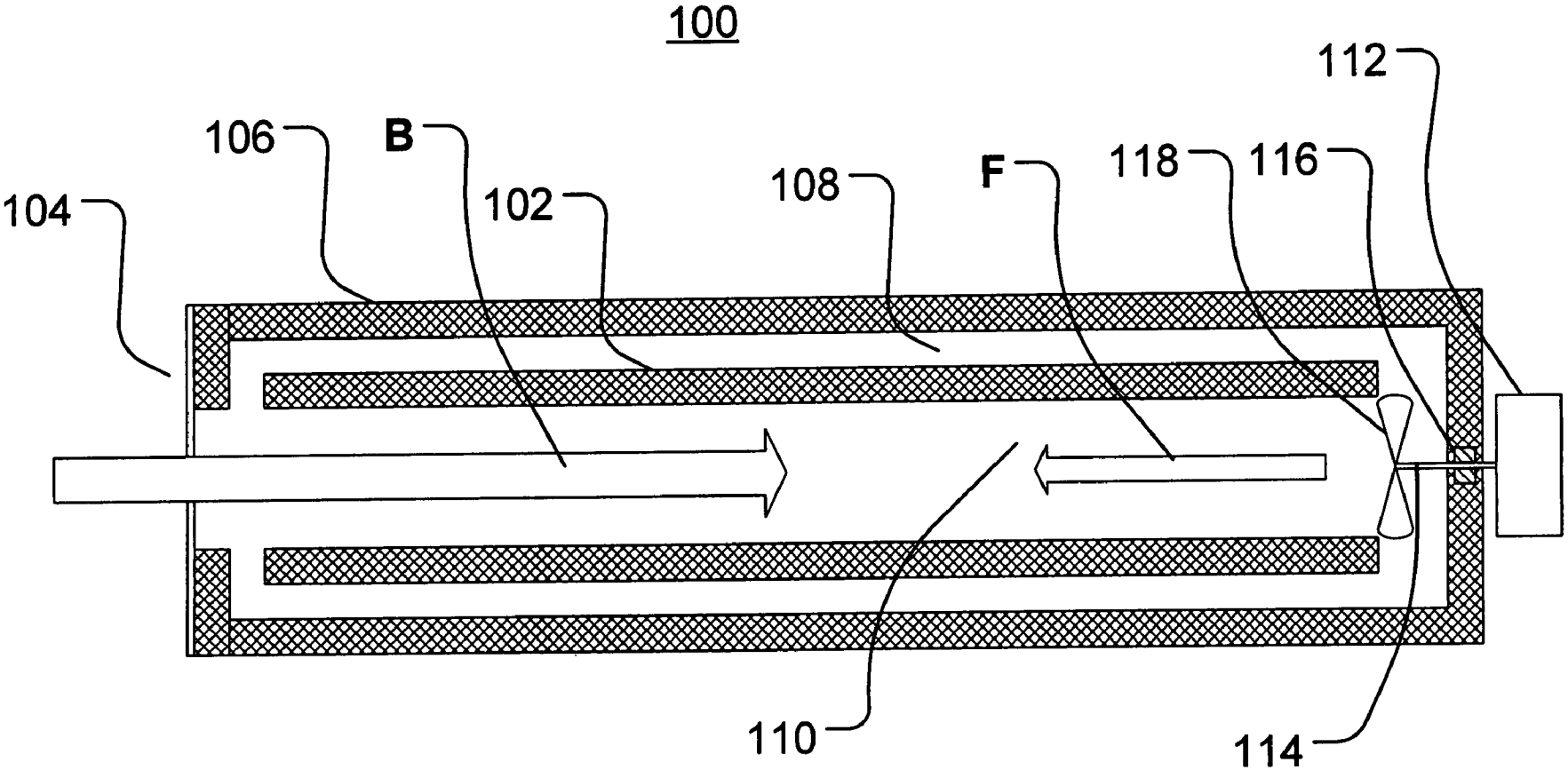
FIG. 1 illustrates a first exemplary target configuration.

These drawings have been provided to assist in the understanding of the exemplary embodiments of the invention as described in more detail below and should not be construed as unduly limiting the invention. In particular, the relative spacing, sizing and dimensions of the various elements illustrated in the drawings are not drawn to scale and may have been exaggerated, reduced or otherwise modified for the purpose of improved clarity. Those of ordinary skill in the art will also appreciate that certain structures that may be commonly utilized in the construction of such couplers, such as tool alignment structures or fixtures, have been omitted simply to improve the clarity and reduce the number of drawings.

DETAILED DESCRIPTION OF EXAMPLE EMBODIMENTS

The particle beam must enter the target, preferably with as little energy loss as possible. The particle beam generation (in the accelerator) and transport to the target must occur in a vacuum to minimize the loss of particles. The high-pressure environment of the target must be isolated from this vacuum yet still allow the particle beam to enter the target chamber. One method of forming a beam window or port utilizes a pair of thin metal foils between which passes helium or another cooling gas to remove the heat produced in the foils by the passage of the particle beam. Another method of forming a beam window or port utilizes a single thin metal foil supported by a water cooled structure referred to as a grid as disclosed in U.S. Pat. No. 5,917,874, the contents of which are hereby incorporated in its entirety. This grid will, however, partially intercept the particle beam, thereby reducing the number of beam particles that will actually enter the target and reach the target nuclei. The advantages provided by thinner entrance foils, e.g., less beam energy lost in passing through the foil, is directly at odds with the advantages provided by thicker entrance foils, e.g., increased mechanical strength that will allow containment of higher pressure.

An improved target assembly as disclosed herein utilizes forced convection to increase the heat transfer from the target gas to the target body which is, in turn, cooled, to reduce the local heating to which the target gas will be subjected during irradiation and thereby reduce the corresponding density reduction. Fluid motion is generated by a fan or blower apparatus incorporated into the fluid chamber. Exemplary embodiments of the improved target assembly are illustrated in FIGS. 1-6. Because the gas velocities generated by forced convection in the inventive target assembly are much higher than those resulting from the natural convection produced as the beam heats the target fluid, higher cooling rates may be obtained.

These higher cooling rates result in reduced temperature variations within the target gas distributed throughout the target chamber and correspondingly increased target nuclei density within the beam path, a combination which tends to improve the yield of the desired isotope product(s) over a conventional target for a given beam current and target fluid loading and/or increased beam currents and target fluid loadings. Similarly, the advantages provided by forced convection also allow either an increase in beam current or a reduction in the volume of target fluid while maintaining or even increasing production of the desired isotope. The selection of the appropriate regime in which to operate targets according to the invention will depend upon which advantage is more desirable to the user.

The improved target assembly includes a blower assembly that is mounted inside or adjacent the target envelope and rotated by an external motor through a direct or magnetic coupling. The blower assembly forces the gas from the central region to the walls of the target where the gas proceeds to the back of the target. The walls of the target envelope may be configured for improved heat transfer through, for example, modification of the surface finish, the addition of fins to increase the heat transfer surface area, or by the addition of metal foam bonded to the target wall to increase the surface area. Metal foam suitable for use in the invention is available commercially from suppliers such as ERG Materials and Aerospace Corporation (Oakland Calif., USA). Although such modifications to the configuration of the walls of the target envelope can improve the cooling performance of the target assembly, the benefits of the present invention are not dependent on such modifications.

A nozzle assembly may be provided toward the rear of the target envelope for directing target gas toward the forward portion of the target envelope where the particle beam is entering the target envelope. The nozzle may be arranged and configured so that the target gas is directed through the target envelope in a direction opposing and generally coaxial with the particle beam entering the target envelope. This flow of target gas has sufficient volume and velocity to at least partially suppress target gas density reduction associated with beam heating and maintain an increased average target gas density within the particle beam and at least partially compensate for the density loss associated with beam heating. Additionally, the heat transfer from the target gas to the surrounding target assembly structure will typically be improved by both the increased gas movement and the more turbulent flow and disruption of the boundary layer of gas at the target envelope surfaces, thereby further suppressing the target gas density reduction.

FIG. 1 illustrates a first exemplary embodiment of the invention 100 which includes an inner sleeve 102, which may be configured as an open cylinder, surrounding a target cavity 110. The inner sleeve 102 is surrounded by an outer jacket 106 that defines the target envelope. A portion of the outer jacket 106 is replaced with a target foil 104 or target window through which the particle beam may enter the target envelope in a beam direction B. As illustrated in FIG. 1, a motor 112 may be provided outside the target envelop and connected via a shaft 114 extending through seals 116 to a fan blade or impeller 118 arranged within the target envelope.

When activated, the fan or impeller 118 will tend to produce a flow of the target fluid through the target cavity in a flow direction F that is in a direction generally opposite that of the beam direction B. The target fluid will tend to flow through the target cavity in a counter current direction relative to the particle beam, thereby counteracting the natural convection resulting from heating of the target fluid by the particle beam and increasing the effective density of the target fluid. As the target fluid reaches the beam end of the target cavity, it will tend to assume a radial flow direction and flow into a space 108 defined between an outer surface of the inner sleeve 102 and a corresponding inner surface of the outer jacket 106. When the opposing surfaces of both the inner sleeve and the outer jacket are generally cylindrical, the space 108 will have a generally annular configuration.

Figure 2:
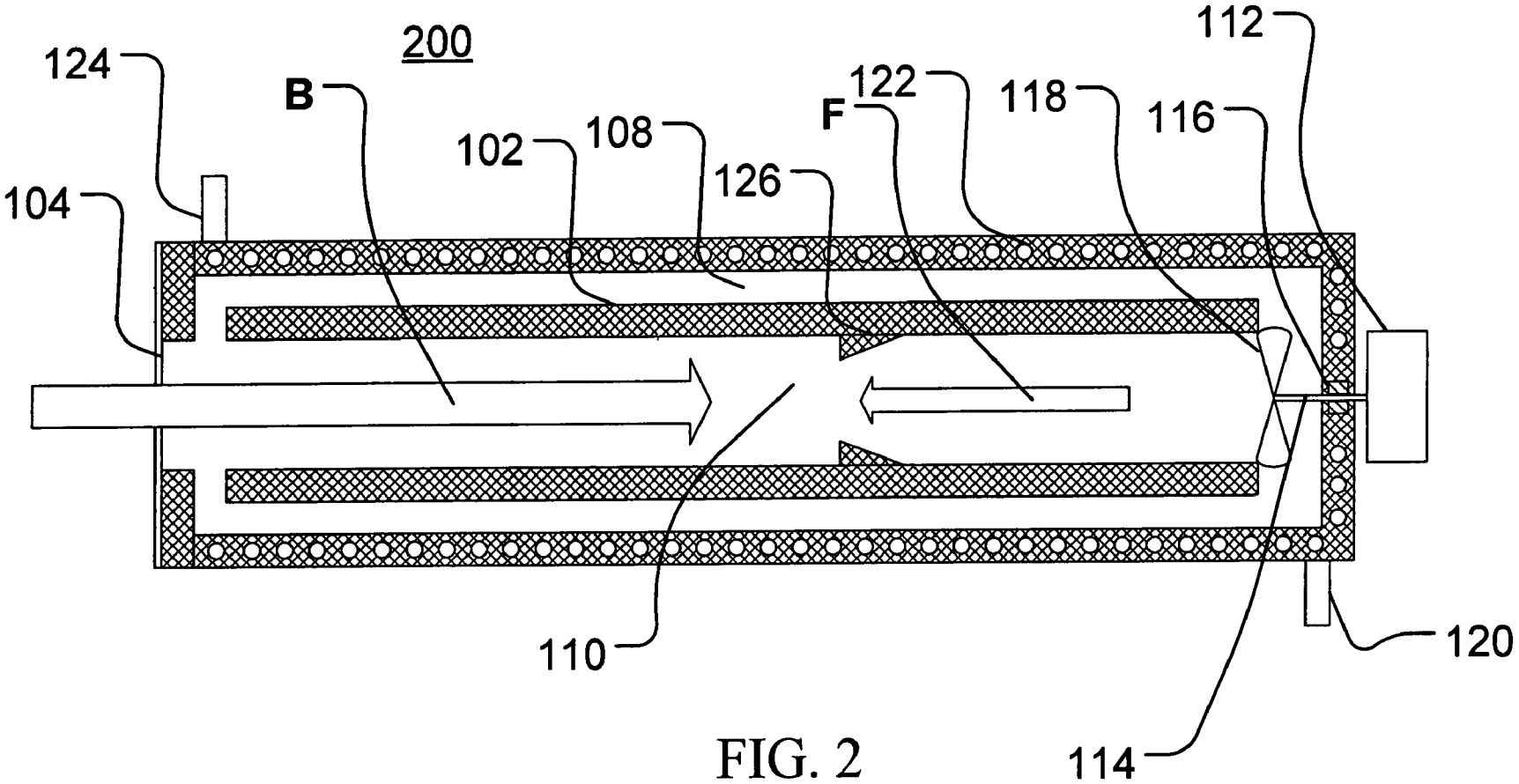
FIG. 2 illustrates a second exemplary target configuration.

FIG. 2 illustrates a second exemplary embodiment of the invention 200 in which the outer jacket 106 includes integral coolant channels 122 through which coolant injected at an inlet 120 will flow through the coolant channels and out through a coolant outlet 124, thereby cooling both the outer jacket and that portion of the target fluid within the space 108. As also illustrated in FIG. 2, the inner surface of the inner sleeve may be provided with one or more deflectors 126 that will tend to redirect the flow of the target fluid induced by the fan or impeller 118 toward a more central region of the target cavity 110.

Figure 3:
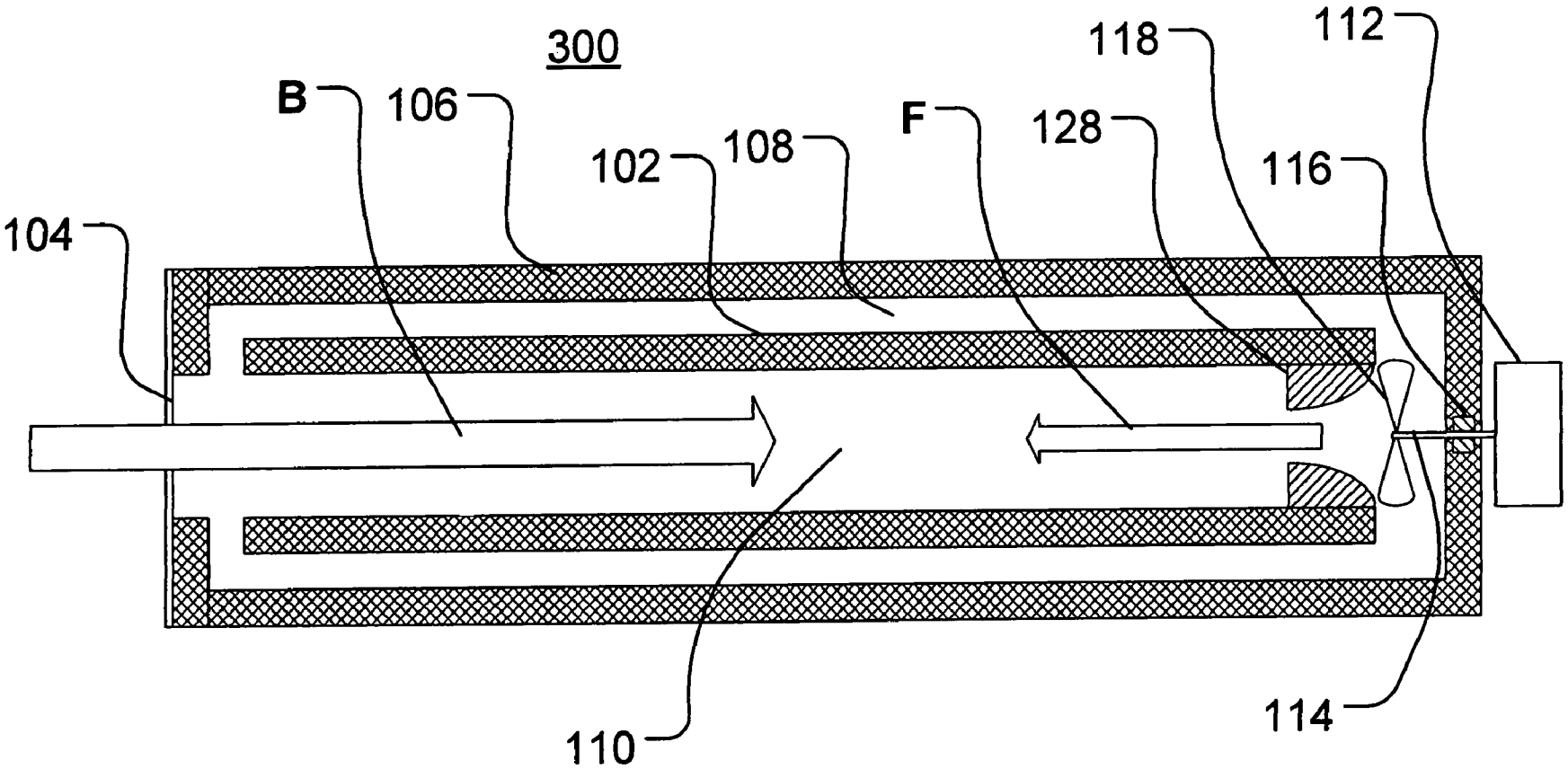
FIG. 3 illustrates a third exemplary target configuration.

FIG. 3 illustrates a third exemplary embodiment of the invention 300 in which a nozzle structure 128 is provided in the inner sleeve 102 adjacent the fan or impeller 118. The nozzle structure will tend to accelerate the flow of the target fluid as it passes into the remainder of the target cavity and may be used to focus the target fluid flow more precisely into the particle beam.

Figure 4:
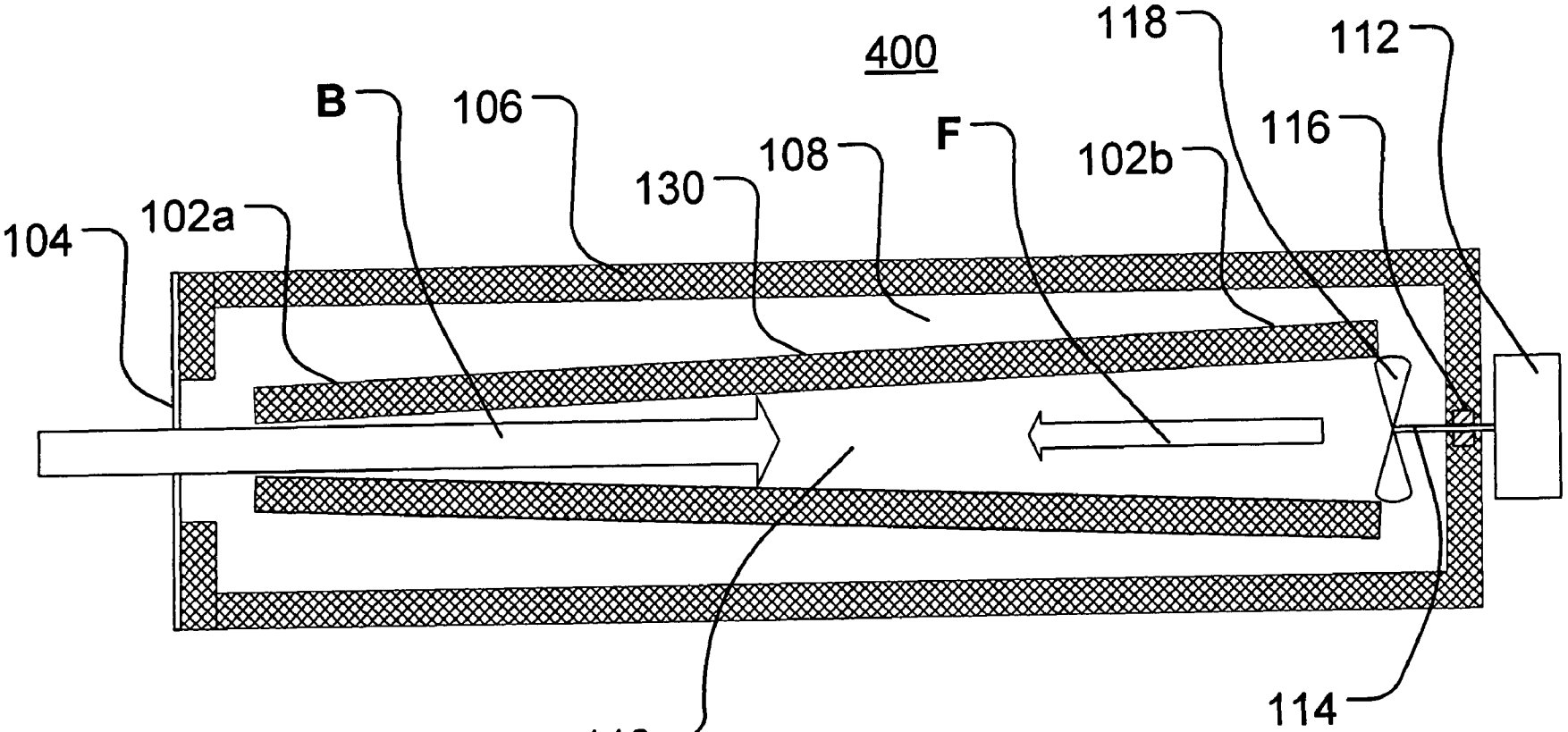
FIG. 4 illustrates a fourth exemplary target configuration.

FIG. 4 illustrates a fourth exemplary embodiment of the invention 400 in which the inner sleeve 102 has a frustoconical configuration with a smaller end, or beam end, 102*a* toward the beam and a larger end 102*b* adjacent the fan or impeller 118. The frustoconical will tend to confine the target fluid and accelerate the flow of the target fluid in the region of the target cavity 110 most closely adjacent the target foil through which the particle beam enters the target envelope. Although, as illustrated, the frustoconical shape tapers along the entire length of the inner sleeve 102, as will be appreciated the tapered region can be substantially confined to the beam end 102*a* with the remaining length being substantially cylindrical.

Figure 5:
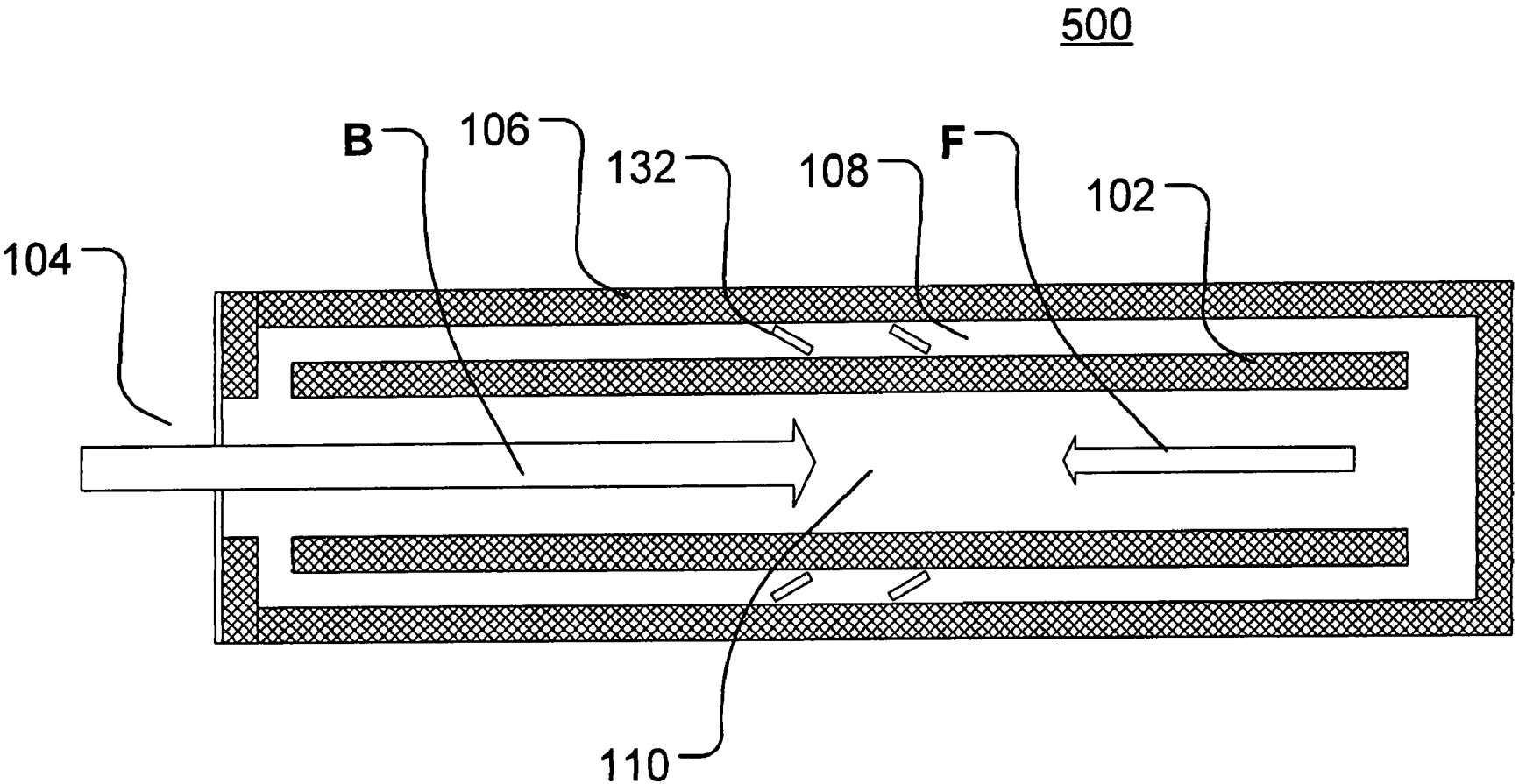
FIG. 5 illustrates a fifth exemplary target configuration.

FIG. 5 illustrates a fifth exemplary embodiment of the invention 500 in which the fluid propelling assembly is arranged within the space defined between the outer surface of the inner sleeve 102 and a corresponding inner surface of the outer jacket 106. As indicated above, the coupling between the motor and the impeller or other blade 132 for compressing and/or accelerating the target fluid may not be direct, but may instead rely on magnetic coupling to reduce the likelihood of leaks and/or contamination within the target envelope.

Figure 6:
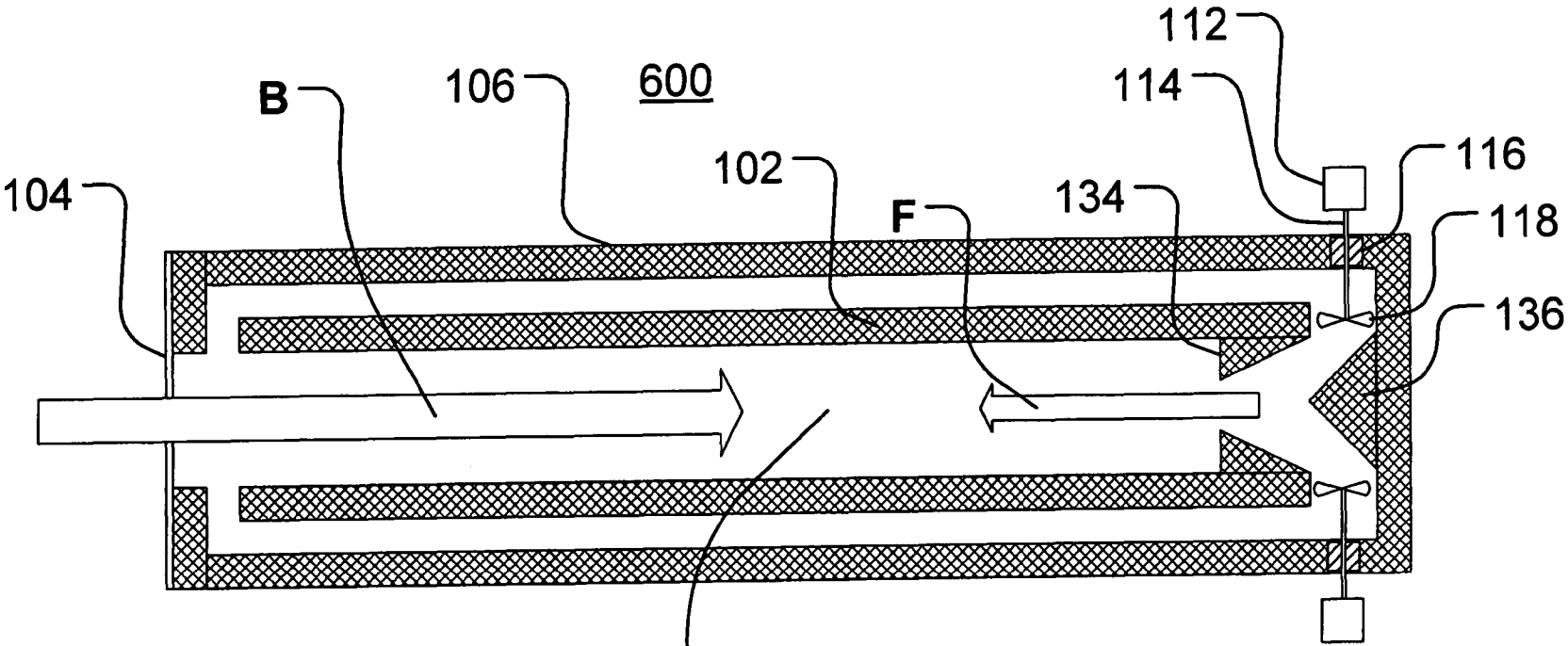
FIG. 6 illustrates a sixth exemplary target configuration.

FIG. 6 illustrates a sixth exemplary embodiment of the invention 600 in which the fluid propelling assembly 112, 114, 116, 118 is arranged generally perpendicular to the longitudinal axis of the target cavity 110. Accordingly, additional diverter and deflector structures 134, 136 may be provided in or adjacent the inner sleeve 102 for redirecting the initial radial flow into an axial flow along the target cavity 110.

In all the embodiments, the deposition of energy from the particle beam into the target fluid causes an increase in pressure in the target assembly. The mechanical strength of the target assembly structure thereby limits the total beam power which may be deposited in the target. The pressure rise observed in the target assembly for a given power deposition is a measure of the heat transfer properties of the target assembly with a lower pressure rise indicating better heat transfer. A heat transfer parameter can be determined for a give target assembly when a known power is deposited in the target from Equation 1. Such an apparatus has been built and heat transfer parameters measured for a target with or without a blower assembly that produces the above described forced convection fluid flow. The results of these tests are shown in Tables 1A (natural convection) and 1B (forced convection).

TABLE 1A

| Natural Convection Target Assembly | | |
|---|---|---|
| Power deposited (watts) | Target Pressure (psig) | Heat Transfer Parameter $W/m^2K$ |
| 0 | 203 | |
| 6 | 213 | 46 |
| 20 | 232 | 58 |
| 41 | 254 | 67 |
| 77 | 283 | 79 |
| 118 | 312 | 89 |
| 180 | 346 | 104 |

TABLE 1B

| Forced Convection Target Assembly | | |
|---|---|---|
| Power deposited (watts) | Target Pressure (psig) | Heat Transfer Parameter $W/m^2K$ |
| 0 | 203 | |
| 7 | 207 | 125 |
| 23 | 216 | 141 |
| 52 | 233 | 142 |
| 93 | 253 | 153 |
| 144 | 276 | 162 |
| 204 | 297 | 178 |

$$h_c = \frac{Q}{AT_1\left(\frac{P_2}{P_1} - 1\right)} \quad \text{Equation 1}$$

where:

$h_c$=heat transfer coefficient

Q=heat input (watts)

A=target internal surface area ($m^2$)

$T_1$=target surface wall temperature (K)

$P_2$=pressure with heat applied (psia)

$P_1$=initial pressure (psia)

Table 1 shows clearly the improved performance of the target assembly to increase the heat transfer properties and reduce the pressure increase in the target fluid. At the same power levels this rather simple and non-optimized embodiment of a forced convection target assembly according to the invention produced a reduced pressure rise of approximately 45% (143 psig to 94 psig) and an increased heat transfer parameter of approximately 70% (180 watts/$m^2$K versus 105 watts/$m^2$K). Accordingly, the present invention will allow the isotope generation process to be run at higher beam currents, with lower target fluid charges, with a thinner target foil and/or with improved yield.

While the present invention has been particularly shown and described with reference to exemplary embodiments thereof, the invention should not be construed as being limited to the particular embodiments set forth herein; rather, these embodiments are provided to convey more fully the concept of the invention to those skilled in the art. In particular, those of ordinary skill in the art will appreciate that various of the structures illustrated and described in connection with the various embodiments may be separately combined to form additional embodiments that also provide the advantages of the present invention. Thus, it will be apparent to those of ordinary skill in the art that various changes in form and details may be made therein without departing from the spirit and scope of the present invention as defined by the following claims.

I claim:

1. A method of preparing a radioisotope product comprising:

introducing a target fluid into a target cavity defined by an inner sleeve arranged within an outer envelope, the inner sleeve and outer envelope defining a return space therebetween, the outer envelope having an elongated body and holding a total volume of the target fluid, the target fluid being present in the target cavity and return space;

irradiating the target fluid within the target cavity with an energetic particle beam to form the radioisotope product, the particle beam having a beam path extending through the inner sleeve from a first end of the elongated body of the outer envelope to a second end of the elongated body of the outer envelope; and inducing movement within the target fluid as it is being irradiated such that the target fluid in the inner sleeve flows countercurrent to the particle beam in the inner sleeve during irradiation from the second end of the outer envelope to the first end of the outer envelope while the target fluid in the return space flows from the first end of the outer envelope to the second end of the outer envelope, wherein the target fluid is recirculated within the inner sleeve and the outer envelope during irradiation without the target fluid exiting the outer envelope.

2. The method of preparing a radioisotope product according to claim 1, wherein the induced movement of the target fluid in the inner sleeve is in a direction that is generally coaxial with and opposite to a direction of the energetic particle beam.

3. The method of preparing a radioisotope product according to claim 1, wherein the induced movement of the target fluid is at least an order of magnitude greater than movement resulting from natural convection.

4. The method of preparing a radioisotope product according to claim 1, wherein the movement is induced with an impeller within the outer envelope.

5. The method of preparing a radioisotope product according to claim 4, wherein the impeller is arranged at the second end of the outer envelope.

6. The method of preparing a radioisotope product according to claim 4, wherein the impeller is arranged in the return space between the inner sleeve and the outer envelope.

7. The method of preparing a radioisotope product according to claim 1, wherein the return space is an annular space.

8. The method of preparing a radioisotope product according to claim 1, wherein the return space decreases from the first end of the outer envelope to the second end of the outer envelope.

9. The method of preparing a radioisotope product according to claim 1, further comprising:

directing the target fluid in the inner sleeve toward a central region of the target cavity as the target fluid flows toward the first end of the outer envelope.

10. The method of preparing a radioisotope product according to claim 8, wherein the target fluid is directed with a deflector structure.

11. The method of preparing a radioisotope product according to claim 9, wherein the target fluid is directed by a tapering of the inner sleeve.

12. The method of preparing a radioisotope product according to claim 1, further comprising:

transferring heat from the target fluid to a coolant.

13. The method of preparing a radioisotope product according to claim 12, wherein the coolant is circulated through one or more channels within the outer envelope.

14. The method of preparing a radioisotope product according to claim 1, wherein the target fluid in the return space is not irradiated by the energetic particle beam as the target fluid flows from the first end of the outer envelope to the second end of the outer envelope.

15. The method of preparing a radioisotope product according to claim 1, wherein the energetic particle beam enters the target cavity through the first end of the outer envelope.

16. The method of preparing a radioisotope product according to claim 1, wherein the movement of the target fluid is induced so as to increase the effective density of the target fluid in the inner sleeve during irradiation.

17. The method of preparing a radioisotope product according to claim 1, wherein the target fluid is recirculated between the target cavity and the return space during irradiation.

18. The method of preparing a radioisotope product according to claim 1, wherein the target fluid is wholly contained within the outer envelope during irradiation.

19. The method of preparing a radioisotope product according to claim 1, wherein the target fluid is a gas.

* * * * *